United States Patent [19]

Muggli

[11] 4,249,168

[45] Feb. 3, 1981

[54] FLAME DETECTOR

[75] Inventor: Jürg Muggli, Männedorf, Switzerland

[73] Assignee: Cerberus AG, Männedorf, Switzerland

[21] Appl. No.: 31,783

[22] Filed: Apr. 20, 1979

[30] Foreign Application Priority Data

Apr. 25, 1978 [CH] Switzerland ..... 4467/78

[51] Int. Cl.[3] ..... G08B 17/12

[52] U.S. Cl. ..... 340/578; 250/339; 340/587

[58] Field of Search ..... 340/578, 587; 250/339, 250/338, 340

[56] References Cited

U.S. PATENT DOCUMENTS

| | | | |
|---|---|---|---|
| 2,897,485 | 7/1959 | Johnson | 340/578 |
| 3,716,717 | 2/1973 | Scheidweiler et al. | 340/578 |
| 3,742,474 | 6/1973 | Müller | 340/578 |
| 3,940,753 | 2/1976 | Müller | 340/578 |
| 4,101,767 | 7/1978 | Lennington et al. | 250/339 |
| 4,160,163 | 7/1979 | Nakauchi | 250/339 |
| 4,160,164 | 7/1979 | Nakauchi | 250/339 |
| 4,179,606 | 12/1979 | Nakauchi et al. | 250/339 |

FOREIGN PATENT DOCUMENTS 2151148 4/1973 France .

OTHER PUBLICATIONS

*Report of Fire Research Institute of Japan*, No. 30, Dec., 1969.

*Primary Examiner*—Glen R. Swann, III

*Attorney, Agent, or Firm*—Frishauf, Holtz, Goodman & Woodward

[57] ABSTRACT

The detector has first and second circuits which are interconnected. The first circuit senses the emission of a flame at least in the wavelength range of carbon dioxide and produces square-wave signals corresponding to the flicker frequency. The second circuit senses short wavelength emission with a wavelength shorter than 3 μm and produces square-wave signals corresponding to the flicker frequency of the emission. The interconnecting means permits the alarm means to be activated only when the first circuit signals and the second circuit signals are present simultaneously and with the same direction, to indicate that the flicker frequency is the same for both emissions. An integrator prevents spurious coinciding signals from resulting in an alarm and a reset circuit periodically resets the integrator. Various specific photoelectric means are described.

18 Claims, 13 Drawing Figures

FLAME DETECTOR

BACKGROUND OF THE INVENTION

The invention relates to a flame detector type of fire alarm with a first circuit which by photoelectric means and a band-pass filter senses the emission of a flame, at least in the wavelength range of carbon dioxide, and also senses the flickering of the flame and produces main signals for an alarm means.

It is generally known that most flammable substances such as wood, petroleum, oil and hydrocarbons or carbohydrates—in short organic materials—emit strongly when burning in the wavelength ranges of approximately $\lambda=2.7$ μm (micrometers) and particularly at approximately $\lambda=4.4$ μm when they burn. Radiation emission takes place in line spectra and band spectra, the wavelength range 2.7 μm being characteristic for both water and carbon dioxide and 4.3 μm being characteristic of only carbon dioxide. The article entitled "Fire Detection using Infrared Resonance Radiation", pages 55 to 60, FIG. 6, which appeared in the journal "Report of Fire Research Institute of Japan", Ser. No. 30 of December 1969 describes the circuit of an alarm which is sensitive to flame emission and temperature. This alarm is designed for the infrared range. However, it is not false alarm-proof. If spurious infrared radiation is present, e.g. radiators or ovens, whose thermal radiation is periodically interrupted by an intervening fan or the like in a particular rhythm, an undesired alarm signal can result although there is no fire or flame.

French Pat. No. 2 151 148 evaluates two wavelength ranges or wavebands for giving alarms in the case of fire. Selectivity results from the arrangement of two narrow-band optical filters which only transmit for the two wavelength ranges $\lambda=2.7$ and $\lambda=4.3$ μm. The photoelectric voltages produced by these two wavelength ranges are evaluated for giving the fire alarm. However, as tests have shown, this alarm tends to give false alarms in the case of spurious radiation sources of suitable colour temperature, so that the false alarm rate cannot be effectively reduced with this alarm.

The object of the present invention is to substantially reduce the false alarm rate of a fire alarm so that, despite the occurrence of interference sources, the alarm clearly recognises each flame or fire as such and gives the necessary alarm signal.

SUMMARY OF THE INVENTION

The invention is directed to a number of desired characteristics for evaluating emissions in the wavelength range of approximately $\lambda=4.4$ μm for alarm-giving purposes. Normal window or lamp glass does not transmit the emission in this wavelength range. This ensures that solar radiation and normal electric light in rooms containing the alarm do not influence the giving of the alarm. Even when the fire alarm according to the invention is located in the open air, i.e. outside rooms, because there is a so-called energy gap at $\lambda=4.3$ μm in the emission spectrum of sunlight, the sun is still not a serious interference source.

The fire alarm according to the invention produces an alarm only if a flame is present which simultaneously emits at a wavelength of approximately $\lambda=4.4$ μm and in the shorter wavelength range $\lambda=0.2$ to 3 μm. No alarm is given for spurious radiation which has a wavelength in only one of these two categories.

According to the invention, these problems are solved in that for differentiating a flame from an interference source there are provided a second circuit and a connecting means with the following components:

- a photoelectric means which receives the flame emission, at least in part, of wavelength in a range of from near ultraviolet to near infrared;
- a band-pass filter with the same flicker frequency range as that of the flame in the first circuit;
- a connecting means interconnecting the first and second circuits and constructed in such a way that when signals are simultaneously and unidirectionally present in the first and second circuits, an output circuit signal is produced for the alarm means.

BRIEF DESCRIPTION OF THE DRAWINGS

FIGS. 8*a* and 8*b* show pulse and wave shapes for explaining the operation of the circuit portion of FIG. 7.

DESCRIPTION OF THE PREFERRED EMBODIMENTS

Figure 1:
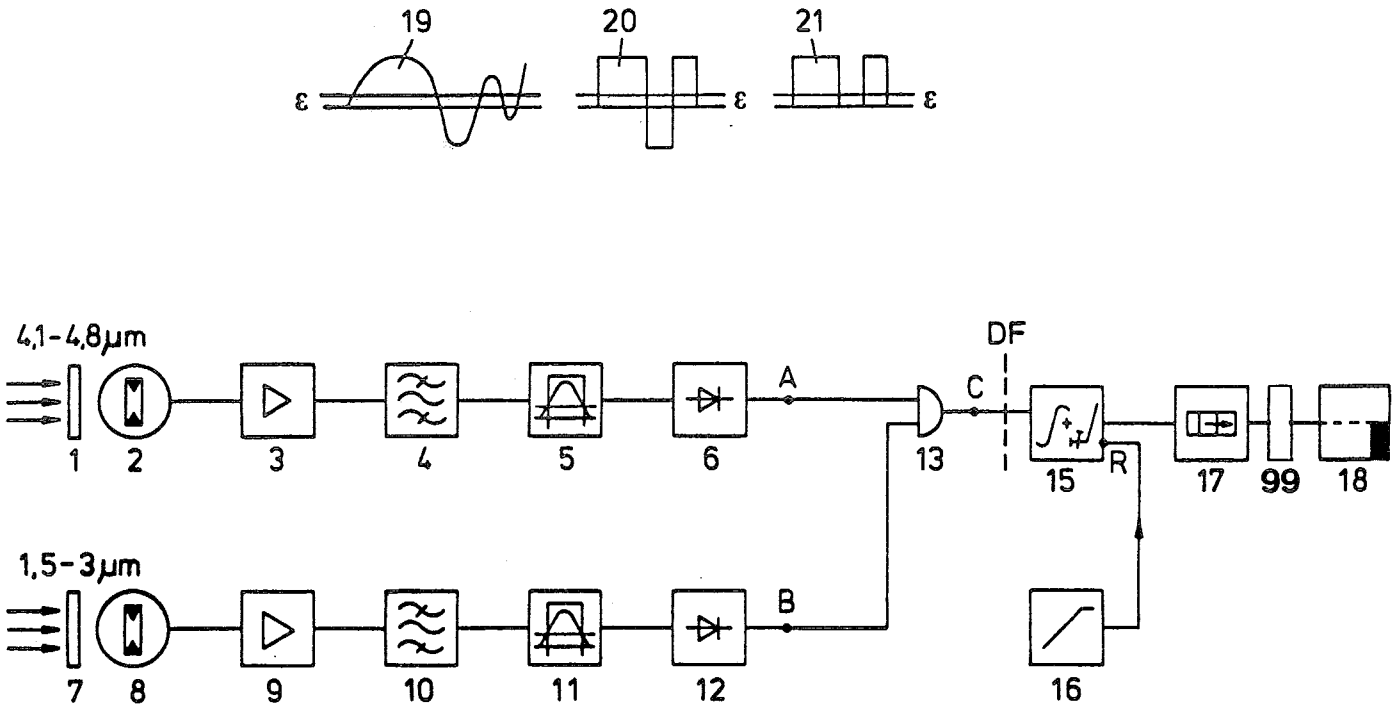
FIG. 1 is a block diagram of a first embodiment of a fire alarm according to the invention, accompanied by graphical representations of the signals therein.

FIG. 1 shows a first embodiment of a flame detector fire alarm according to the invention and comprising two circuits. The first circuit is equipped with a filter 1 and a photoelectric means 2 with a transmission in the wavelength range $\lambda=4.1$ to 4.8 μm. This wavelength range is such that flame emission radiation passes through filter 1 to the photoelectric means, constructed as a sensitive element 74 in FIG. 9, where corresponding main electrical signals are released. These main signals are amplified in the following amplifier 3. The following band-pass filter 4 has a transmission range between 4 and 15 Hz for the flame flicker frequency and is shown at the top of FIG. 1 as a signal wave 19. In the following comparator 5 wave 19 is processed in such a way that there are produced pulses 20 having a width dependent on the cycle of oscillations of the wave 19. A threshold value $\epsilon$ barrier is provided in this first circuit for suppressing noise. The width of pulses 20 is dependent on the passage of oscillations 19 through the threshold value $\epsilon$ barrier. In the following rectifier, the pulses 20 are rectified into pulses 21. Pulses 21, whose width is dependent on the cycles of oscillations 19 of the flame flicker frequency are located at point A of the first circuit. The filter 7 for the short-wavelength range of the flame, e.g. $\lambda=1.5$ to 3 $\mu$m, is provided in the second circuit. The photoelectric means 8 receives the flame emission in this range. In the following amplifier 9 which may be interconnected with amplifier 3 as shown in U.S. Pat. No. 3940753, the oscillations are amplified and pass to band-pass filter 10, which only transmits the oscillations within the flicker frequency range of the flame of 4 to 15 Hz. The oscillations 19 leave the band-pass filter and reach comparator 11, where they are treated in the same way as described in conjunction with the first, or main circuit. In the second, or tripping circuit there follows the rectifier 12 which rectifies pulses 20 into pulses 21. On receiving the flame emission, the pulses 21 at point B of the tripping circuit are synchronous and unidirectional with those of point A. The connecting means 13, which in this embodiment is constructed as an AND gate, produces an output signal at point C. This pulse reaches the following integrator 15 which, by means of the timing element 16, is reset after a given time of e.g. 5 to 15 seconds. In the case of a digital construction of the AND gate 13, integrator 15 contains a counter for counting the output pulses. Only when a number of output pulses has entered the counter, and a predetermined threshold value previously set on the counter has been exceeded, does the integrator 15 supply an alarm pulse to the following circuit parts. The alarm pulse can be produced in the integrator only if the counter threshold value is exceeded prior to resetting by time switch 16. To ensure that an alarm is not given too rapidly, e.g. within two seconds, a delay element 17 is provided which delays the transmission of the alarm signal by a few seconds and only triggers the alarm exchange 18 if within this time the alarm signal from integrator 15 still persists. A threshold signal device 99 in front of the alarm exchange 18 blocks signals of insufficient energy for proper triggering. In the embodiment of FIG. 1, a dotted line DF is plotted between AND gate 13 and integrator 15, which means that in a special embodiment, the pulse length discriminator described in greater detail relative to FIG. 7 can be used. The circuit of FIG. 1 produces a signal at the output of the AND gate 13 if a signal modulated with the flicker frequency is present in both the main circuit and the tripping circuit.

The individual electronic circuit components of the two circuits of FIG. 1 are not described in detail because they are known from the relevant literature, reference being specifically made to the following:

"Linear Applications Handbook" Volumes 1 and 2, 1977, National Semiconductor Corporation.

"Applications of Operational Amplifiers", Publishers, McGraw-Hill Co., New York, 1976.

"Sourcebook of Electronic Circuits", Publishers, McGraw-Hill, New York, 1968.

U.S. Pat. Nos. 3,742,474 and 3,940,753.

Figure 2:
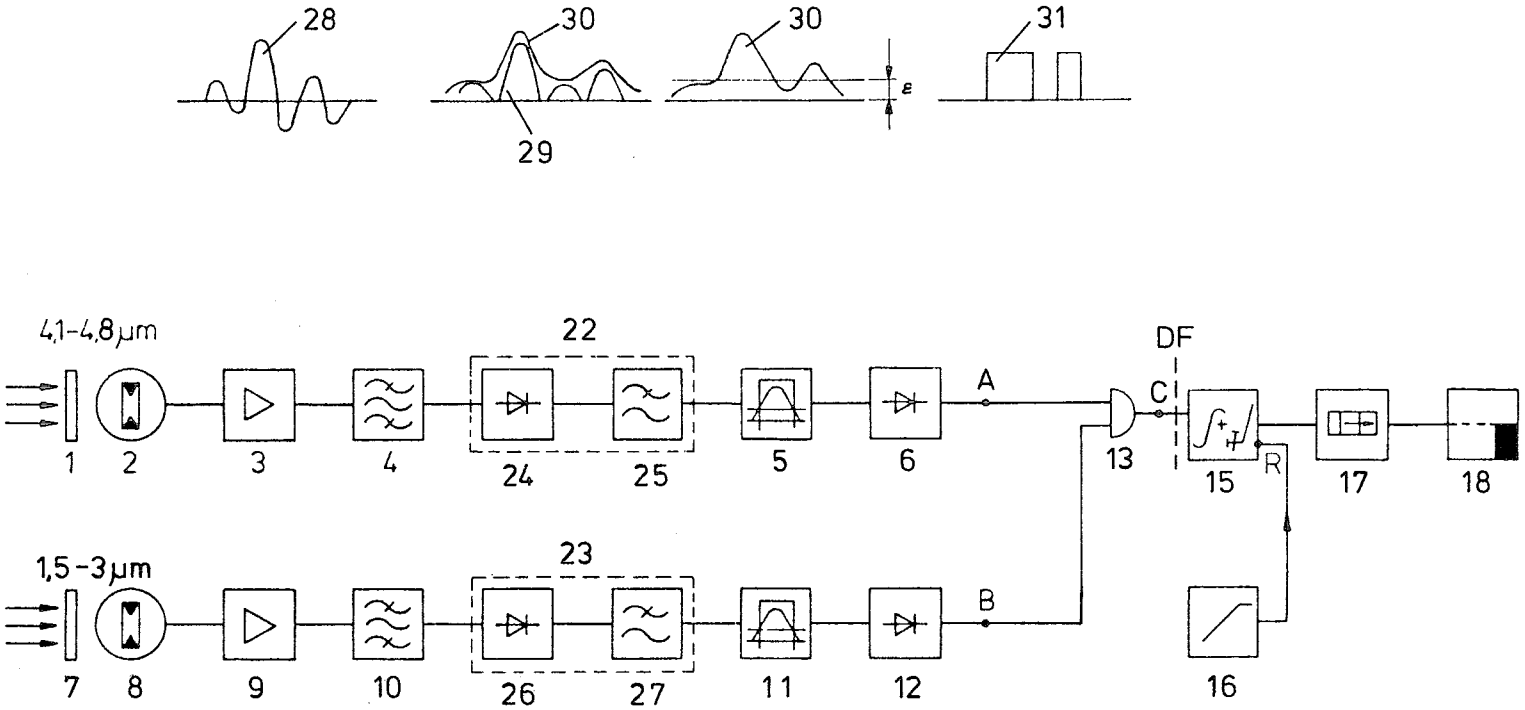
FIG. 2 is a block diagram of a second embodiment of a fire alarm according to the invention, accompanied by graphical representations of the signals therein.

The embodiment of FIG. 2 is similarly constructed to that of FIG. 1. However, demodulators 22 and 23 are arranged behind the band-pass filters 4, 10. Each of these demodulators comprises a rectifier 24 or 26 and a low-pass filter 25, 27. Amplitude comparators 5, 11 and rectifiers 6, 12 are arranged behind the demodulators 22, 23. Through the arrangement of demodulators 22, 23, the modulation envelope curve 30 of the rectified signal half-waves 29 can be formed from the flame flicker frequency 28. The amplitude comparators 5, 11 take account of the predetermined threshold value $\epsilon$ in the same way as was explained relative to FIG. 1. However, it is pointed out that at points A and B of the main and tripping circuits there are present pulses 31 whose width is dependent on the passage of the envelope curve 30 through threshold value $\epsilon$ barrier. The amplitude of the pulses 31 is constant. In the case of simultaneous presence of pulses 31 at points A, B, the AND gate 13 supplies an output signal to integrator 15. Integrator 15 and timing switch 16 function in the same way as described relative to the embodiment of FIG. 1. If desired, it is possible to insert the pulse length discriminator of FIG. 7 between AND gate 13 and integrator 15 at the point in the connecting line indicated by dotted line DF. The delay element 17 and the alarm means 18 function in the same way as described above. The individual circuit components of the embodiment of FIG. 2 are described in the already-quoted literature.

The third embodiment of FIG. 3 again comprises the two circuits (main circuit and tripping circuit) and a connecting means 34, which in this case is constructed as a phase comparator. Filters 1, 7 have the same transmission range as in the earlier embodiments. In the same way, photoelectric means 2, 8 are constructed in equivalent manner. Amplifiers 3, 9 amplify the signals. The filters 4 and 10 permit the passage of the flame flicker frequency only in the range 4 to 15 Hz. Threshold value detectors 32, 33 are arranged behind these band-pass filters. Threshold value detector 32 receives the oscillations 36 from band-pass filter 4 and produces a main output signal on exceeding a given threshold value. Threshold value detector 33 receives the oscillations from the band-pass filter corresponding to the flicker frequency of the shortwave flame emission and produces a tripping output signal on exceeding a given threshold value. The output signals of the two threshold value detectors are at points A and B of the two circuits. If the output signals are unidirectional, the connecting means, which is constructed as a phase comparator 34, produces an output signal C. The signals at points A and B must be unidirectional. The term "unidirectional" means that the same sign of the signals must be present at the two inputs of the phase discriminator 34. The output signal at point C of phase discriminator 34 is rectified in rectifier 35. The operation of integrator 15, time switch 16, delay element 17 and alarm means 18 is the same as in the two previously discussed embodiments.

Figure 4:
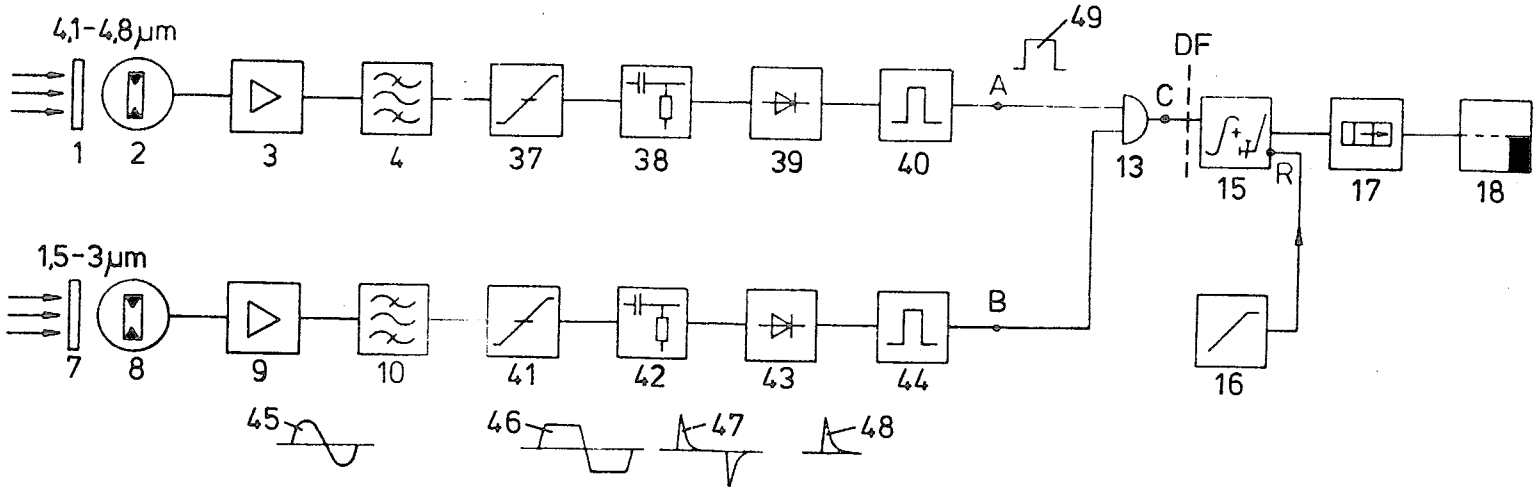
FIG. 4 is a block diagram of a fourth embodiment of a fire alarm according to the invention, accompanied by graphical representations of the signals therein.

The embodiment of FIG. 4 has substantially the same components as those of the other embodiments. The components which differ are described in detail. Signals 45 are produced at the outputs of band-pass filters 4, 10 due to the flame emission at a frequency of 4 to 15 Hz. These signals are limited in amplitude limiters 37, 41. The resulting trapezoidal signals 46 pass to the differentiating element 38 or 42, which produces a voltage pulse 47 for each wave front of signals 46. These pulses are rectified in the following rectifiers 39, 43 in such a way that only voltage pulses 48 with one polarity reach the following monostable multivibrator 40 or 44. These two monostable multivibrators produce pulses 49 of constant amplitude and width. The amplitude and width are not in this case dependent on the intensity of the flame. In this embodiment, the connecting means is constructed as an AND gate 13. If the pulses are simultaneously present at points A and B, the AND gate 13 produces a signal at its output C which reaches the following integrator 15 with time switch 16. The operation is the same as described above. The same also applies for the delay element 17 and the alarm means 18. If required, a pulse length discriminator according to FIG. 5 can be inserted between the AND gate 13 and the integrator 15. This is indicated by the dotted line DF in the embodiment of FIG. 4.

It is finally pointed out that the embodiments of FIGS. 1, 2, 3 and 4 can have a main circuit for the main flame emission signals and a plurality of tripping circuits for the short-wave flame emission. Thus, each of the tripping signal circuits would operate in a different wavelength range, while the main signal circuit operates with a wavelength of approximately 4.4 μm.

Figure 5:
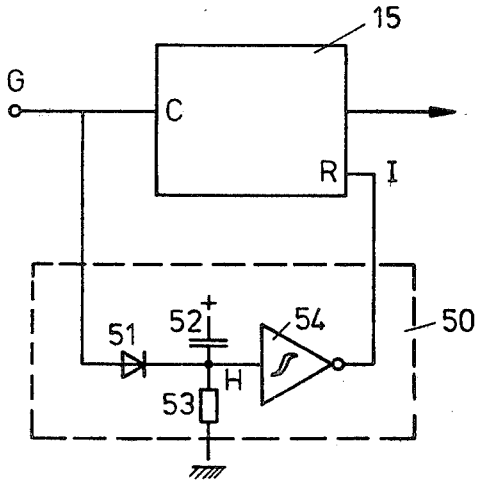
FIG. 5 is a more detailed circuit diagram of a portion of the circuits of FIGS. 1–4.
Figure 6A:
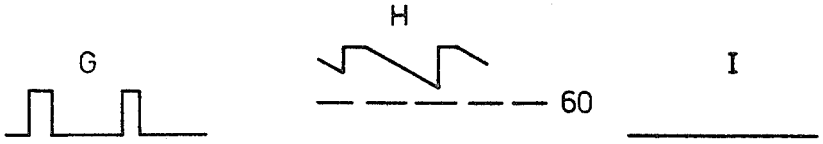
FIGS. 6*a* and 6*b* are graphical representations of signal wave shapes for describing the functioning of the circuit of FIG. 5.
Figure 6B:
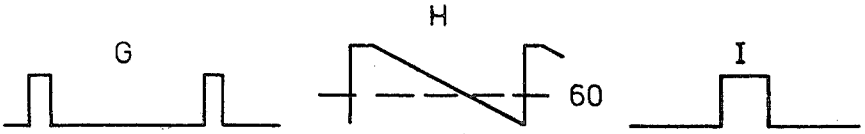

FIG. 5 shows a further embodiment of the integrator 15 of the embodiments of FIGS. 1, 2, 3 and 4. The integrator of FIG. 5 has a different time switch 50 which resets the integrator content if for a given time no pulse is produced by connecting member 13 and 34. The operation is explained by reference to FIGS. 6*a* and 6*b*. If a pulse from the connecting means is present at point G and reaches the input of integrator 15, capacitor 52 is positively discharged across diode 51. This is indicated in FIG. 6*a* with the steep front of wave train H. After a given time, the capacitor is charged by the RC constant of capacitor 52 and resistor 53. As soon as a pulse is supplied within a given time from the connecting means to the input of integrator 15, capacitor 52 is discharged again. According to FIG. 6*a*, this takes place above the threshold value 60 represented by wave H. The subsequent inverting Schmitt trigger 54 at its output in this case produces no signal I at the resetting input of integrator 15, so that the content of the latter is not reset. If a pulse is not received from the connecting means for a relatively long time, such as is indicated e.g. in FIG. 6*b*, the charging time rhythm of capacitor 52 also changes according to wave H of FIG. 6*b*, which now no longer moves above threshold value 60. In this case a signal I is produced at the output of Schmitt trigger 54, which resets the content of integrator 15. The time constant of the RC element 52, 53 moves in the range between 0.1 and 1 second.

Figure 7:
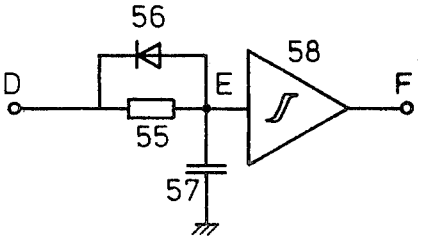
FIG. 7 shows diagrammatically in more detail an element of the circuits of FIGS. 1, 2 and 4.
Figure 8A:
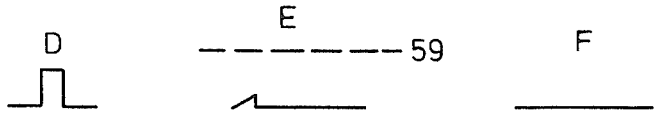
FIGS. 8*a* and 8*b* are graphical representations of signal wave shapes for describing the functioning of the circuit of FIG. 7.
Figure 8B:
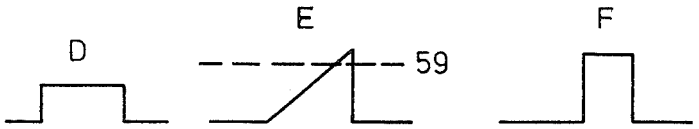

The pulse length discriminator of FIG. 7 is positioned between connecting means 13 and integrator 15 when it is intended to prevent minute pulses from the connecting member to summate the content of integrator 15. A pulse is produced at output F only by those pulses lasting more than a minimum time, e.g. 1 millisecond. This is shown in FIGS. 8*a* and 8*b*. FIG. 8*a* shows input pulses D within the minimum time in question. The voltage increases only slightly at point E (connection of resistor 55, capacitor 57, diode 56 and Schmitt trigger 58), so that the voltage is below the threshold value 59, so that Schmitt trigger 58 does not produce a pulse at output F. If the input pulses are over the minimum time, as indicated in FIG. 8*b*, then Threshold value 59 is exceeded at point E of the pulse length discriminator of FIG. 7. At its output, Schmitt trigger 58 produces signal F, which reaches the input of integrator 15.

Figure 9:
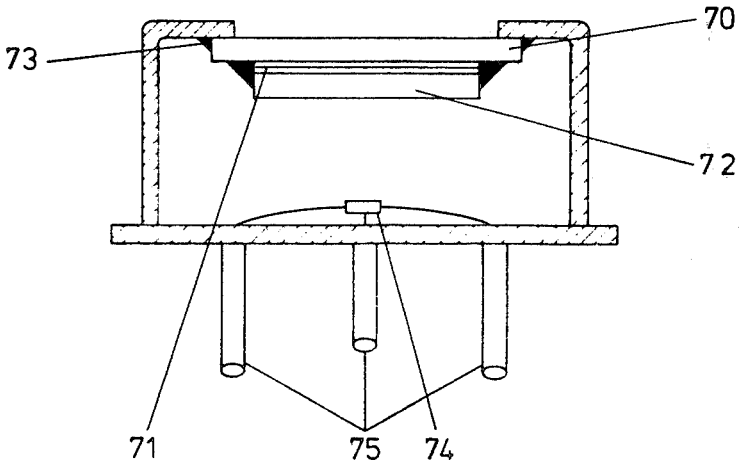
FIG. 9 shows a filtering and photoelectric means for the embodiments of FIGS. 1, 2, 3 and 4.

FIG. 9 shows the constructional embodiment of the filter, including the photoelectric means as can be used in the embodiments of FIGS. 1, 2, 3 and 4. According to FIG. 9, filter 1 of the main circuit comprises a germanium or silicon layer 70, an interference filter 71 and a quartz or sapphire layer 72. These different layers are plane parallel, the thickness of the germanium layer 70 being approximately 1 mm (millimeters), that of the interference filter 1 approximately 1 to 50 μm, and that of the quartz or sapphire layer 72 approximately 0.5 mm. The diameter of these layers or filter 1 is approximately 8 to 12 mm. Interference filter 71 can comprise a plurality of layers. The material of these layers can be metallic, dielectric, or a semiconductor. The filter comprising layers 70, 71 and 72 is placed in a so-called TO-5 casing. Such a casing is widely available commercially under this trade name and is connected to the filter by means of an adhesive 73. The sensitive element 74, together with a field effect transistor, is provided in the casing. This element converts the optical rays into electrical signals, which pass via lines 75 to the circuits of FIGS. 1, 2, 3 and 4. Sensitive element 74 can be a pyroelectric detector, such as e.g. lithium-tantalate or lead-zircanatetitanate, an NTC thermistor, a photoconductor, or a thermopile. The filter and/or the photoelectric means 1, 2 is provided for the main circuit in the embodiments of FIGS. 1, 2, 3 and 4. Filter 7 and/or photoelectric means 8 for the trigger circuits of the same embodiments can be constructed in the same way, the following components being used with particular advantage: a photovoltaic cell or an UV-sensitive, gas-filled tube.

Figure 10A:
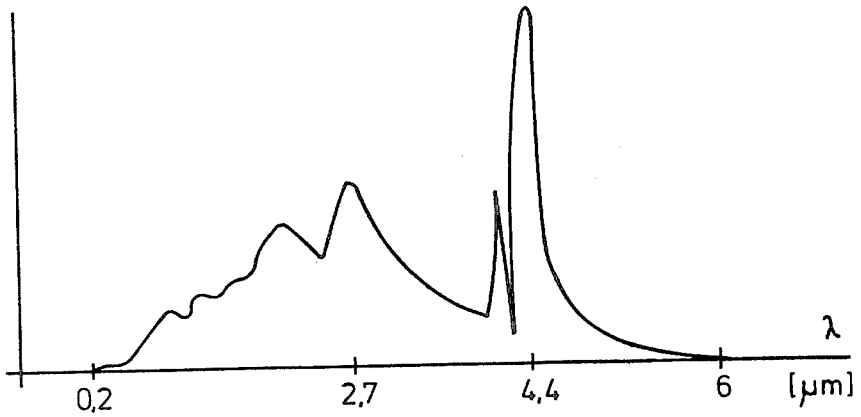
FIG. 10*a* is a graph showing the radiation intensity distribution over the wavelength range of a flame.

FIG. 10*a* shows the intensity distribution of a typical flame spectrum. The wavelength λ is shown in the unit μm on the abscissa, while the ordinate shows the intensity at the particular wavelength. FIG. 10*a* clearly shows a strong intensity in near the wavelength $\lambda=4.4$ μm, which is that characteristic of carbon dioxide. The intensity distribution has two pronounced maxima, at 2.8 μm and at 4.4 μm.

Figure 10B:
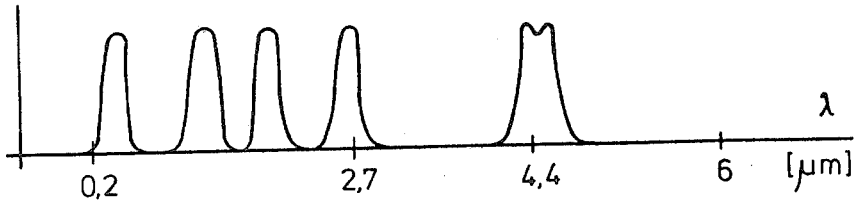
FIG. 10*b* is a graph showing the transmission ranges of a fire alarm with a plurality of circuits.

FIG. 10*b* shows various possible transmission ranges for the filters for the tripping circuits and main circuit for determining in optimum manner the flame spectrum of FIG. 10*a*. Each of the circuits of FIGS. 1, 2, 3 and 4 is sensitive to one of a plurality of wavelength transmission ranges shown in FIG. 10*b*, e.g. the ranges of 4 to 4.8 μm, 3 to 3.8 μm, 1.8 to 2.8 μm, 0.7 to 1.2 μm, or 0.1 to 0.5 μm. The amplifiers 3, 9 of the circuits have an adjustable amplification factor. The amplification factors of the individual amplifiers are inversely proportional to the intensity distribution of FIG. 10*a*, which means that the fire alarm comprising the various circuits has a uniform sensitivity over the entire wavelength range of FIG. 10*a*. As a result, interference sources emitting with a spectrum different than that of the flame of FIG. 10*a* cannot set off an alarm.

I claim:

1. A flame detector of the type having a first circuit for sensing radiation comprising the flame-resonant radiation wavelength which is characteristic of carbon dioxide and in response thereto generating an electrical alarm signal for activating an alarm means, the first circuit comprising a photoelectric means for producing a first circuit signal and a band-pass filter which passes the first circuit signal only at the flicker frequency of the flame, wherein the improvement comprises:

a second circuit for sensing the presence of radiation of the same flicker frequency as that sensed by the first circuit, said second circuit comprising in series:

a photoelectric means (7, 8) which senses radiation of a selected wavelength range within the radiation range between near ultra-violet to near infra-red to produce a second circuit signal, and a band-pass filter (10) having the same flicker frequency pass band as the band-pass filter of the first circuit, and connecting means (13, 14) interconnecting said first and second circuits and comprising:

means for comparing said first and second circuit signals and permitting activation of said alarm by an alarm signal only when there are present simultaneous first circuit signals and second circuit signals in the same direction.

2. The detector according to claim 1, wherein said first circuit comprises in series:

a first circuit radiation filter (1) which selectively transmits infra-red radiation of a flame, a photoelectric means (2) which receives the radiation transmitted by the radiation filter and produces corresponding first circuit electrical signals, an amplifier (3) for amplifying the first circuit signals from the photoelectric means (2), a band-pass filter (4) with a pass band corresponding to the flicker frequency of the radiating flame, and a signal converter (5, 6) which differentiates and converts the amplified first circuit signals passed by the band-pass filter (4) to square-wave signals (21) of equal amplitude and with a width which is dependent on the period of each oscillation (19) of the first circuit signals representing the flicker frequency, wherein said second circuit comprises, in series;

a second circuit radiation filter (7) which selecticely transmits flame radiation with a wavelength less than 3 μm, a photoelectric means (8) which receives the radiation transmitted by the second circuit radiation filter and in response thereto produces second circuit electrical signals, an amplifier (9) for amplifying the second circuit signals from the photoelectric means (8), a band-pass filter (10) with a pass band similar to that of the first circuit band-pass filter, and a signal converter (11, 12) which differentiates and converts the amplified second circuit signals passed by the second circuit band-pass filter to square-wave signals of equal amplitude and with a width which is dependent on the period of each oscillation (19) of the first circuit signals representing the flicker frequency, wherein said connecting means (13) is an AND gate with a first input connected to receive the first circuit square-wave signals (21) and a second input connected to receive the second circuit square-wave signals (FIG. 1).

3. The detector according to claim 1, wherein said first circuit comprises in series:

a first circuit radiation filter (1) which selectively transmits infra-red radiation of a flame, a photoelectric means (2) which receives the radiation transmitted by the radiation filter and produces corresponding first circuit electrical signals, an amplifier (3) for amplifying the first circuit signals from the photoelectric means, a band-pass filter (4) with a pass band corresponding to the flicker frequency of the radiating flame, and a signal converter (22) which generates square-wave impulses (31) having a constant amplitude and a width which is dependent on the period of each oscillation (28) of the first circuit signals representing the envelope curve (30) of the flicker frequency, wherein said second circuit comprises, in series:

a second circuit radiation filter (7) which selectively transmits flame radiation with a wavelength less than 3 μm, a photoelectric means (8) which receives the radiation transmitted by the second circuit radiation filter and in response thereto produces second circuit electrical signals, an amplifier (9) for amplifying the second circuit signals from the photoelectric means (8), a band-pass filter (10) with a pass band similar to that of the first circuit band-pass filter, and a signal converter (23) which generates second circuit square-wave impulses of constant amplitude and with a width which is dependent on the period of each individual oscillation (28) of the second circuit signals representing the envelope curve of the flicker frequency; and wherein said connecting means (13) is an AND gate with a first input connected to receive the first circuit square-wave signals (31) and a second input which is connected to receive the second circuit square-wave signals (FIG. 2).

Figure 3:
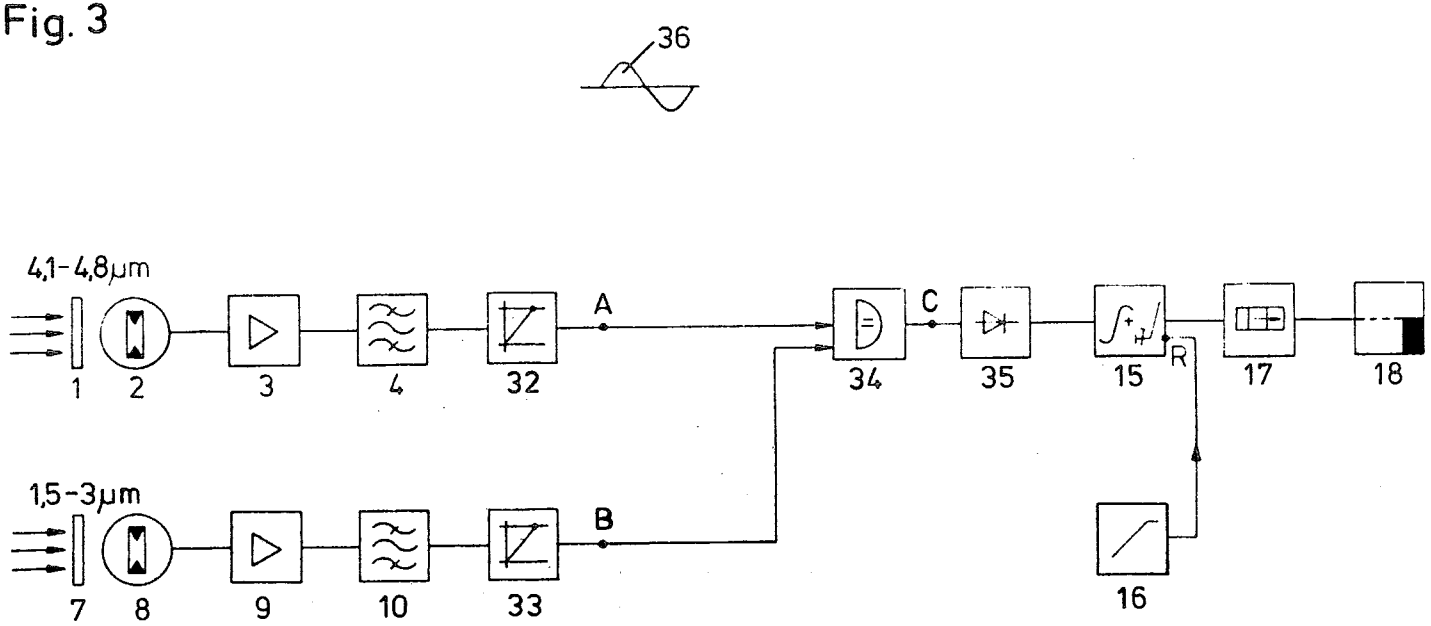
FIG. 3 is a block diagram of a third embodiment of a fire alarm according to the invention, accompanied by graphical representations of the signals therein.

4. The detector according to claim 1, wherein said first circuit comprises, in series:

a first circuit radiation filter (1) which selectively transmits infra-red radiation of a flame, a photoelectric means (2) which receives the radiation transmitted by the radiation filter and produces corresponding first circuit electrical signals, an amplifier (3) for amplifying the first circuit signals from the photoelectric means (2), a band-pass filter (4) with a pass band corresponding to the flicker frequency of the radiating flame, and a threshold value switch (32) which receives from the band-pass filter (4) the electrical oscillations (36) representative of the flicker frequency of the flame and generates a first circuit output signal when a particular threshold value is exceeded, wherein said second circuit comprises, in series:

a second circuit radiation filter (7) which selectively transmits radiation with a wavelength less than 3 μm, a photoelectric means (8) which receives the radiation transmitted by the second circuit radiation filter and in response thereto produces second circuit electrical signals, an amplifier (9) for amplifying the second circuit signals from the photoelectric means (8), a band-pass filter (10) with a pass band similar to that of the first circuit band-pass filter, and a threshold value switch (33) which receives from the second circuit band-pass filter the electrical oscillations representative of the short wavelength radiation flicker frequency of the flame and generates a second circuit output signal when a particular threshold value is exceeded, wherein said connecting means (34) is a phase comparator which receives at a first input the first circuit output signal of the first circuit threshold value switch and receives at a second input the second circuit output signal of the second circuit threshold value switch (FIG. 3).

5. The detector according to claim 1, wherein said first circuit comprises, in series:

a first circuit radiation filter (1) which selectively transmits infra-red radiation of a flame, a photoelectric means (2) which receives the radiation transmitted by the radiation filter and produces corresponding first circuit electrical signals, an amplifier (3) for amplifying the first circuit signals from the photoelectric means (2), a band-pass filter (4) with a pass band corresponding to the flicker frequency of the radiating flame, and a signal limits (37, 38, 39, 40) which converts the amplified signals, differentiates, and generates first circuit square-wave impulses (49) with a constant amplitude and width, wherein said second circuit comprises, in series:

a second circuit radiation filter (7) which selectively transmits short wavelength radiation with a wavelength less than 3 μm, a photoelectric means (8) which receives the radiation transmitted by the second circuit radiation filter and in response thereto produces second circuit electrical signals, an amplifier (9) for amplifying the second circuit signals from the photoelectric means (10), a band-pass filter (10) with a pass band similar to that of the first circuit band-pass filter, and a signal limits (41,42,43,44) which converts the amplified signals, differentiates, and generates second circuit square-wave impulses with a constant amplitude and width, wherein said connecting means (13) is an AND gate with a first input connected to receive the first circuit square-wave signals and a second input which is connected to receive the second circuit square-wave signals (FIG. 4).

6. The detector according to claim 1, wherein there is connected to the connecting means (13,34) an integrator (15) which adds the output signals of the connecting means and which has a resetting circuit (16) for periodically resetting the added content of the integrator (15) to prevent the activation of the alarm means by spurious undesired individual impulses (FIGS. 1, 2, 3, 4).

7. The detector according to claim 6, wherein the integrator (15) includes a counter which counts the output signals of the connecting means (13) and wherein the resetting circuit (16) includes means which reset the counter periodically within a certain time period.

8. The flame detector according to claim 7, wherein the resetting circuit (16) includes a capacitor (52) which adds the output signals of the connecting means (13, 34) and wherein the resetting circuit (16) further includes means (51) which discharge the capacitor with a greater time constant than that with which it is charged by the output signals of the connecting means (18).

9. The flame detector according to claim 6, wherein the input of the resetting circuit is connected to the input of the integrator and comprises means which reset the summed input of the integrator when there are no output signals within a certain time period.

10. The flame detector according to claim 6, wherein there is connected to the integrator (15) a threshold value switch which generates an output signal for an alarm means (18) when the sum of the signals of the integrator (15) exceeds a certain threshold value (FIGS. 1,2,3,4).

11. The flame detector according to claim 10, comprising an impulse length discriminator (55,56,57,58) connected between the connecting means (13,34) and the integrator (15) which permits only impulses of a certain minimum width to pass to the integrator (FIG. 7).

12. The flame detector according to claim 10, comprising a delay line (17) between the threshold value switch and the alarm means (18), the delay line (17) delaying in time the output signal of the integrator to the alarm means (18).

13. The flame detector according to claim 1, comprising at least two circuits for generating electrical signals corresponding to the flame radiation and sensing radiation in wavelength ranges chosen from the ranges of from 4 to 4.8 μm, 3 to 3.8 μm, 1.8 to 2.8 μm, 0.7 to 1.2 μm, and 0.1 to 0.5 μm.

14. The flame detector according to claim 1, wherein the filter of the first circuit comprises a quartz or sapphire layer (72), a semiconductor layer (70) and an interference filter (71) which passes radiation in the wavelength range of 4.0 to 4.8 μm (FIG. 9).

15. The flame detector according to claim 14, wherein the semiconductor layer (70) is a layer of germanium.

16. The flame detector according to claim 1, wherein the photoelectric means of the first circuit comprises a substance chosen from the group consisting of lithium tantalate ($LiTaO_4$) and lead selenide (PbSe).

17. The flame detector according to claim 1, wherein the photoelectric means of the second circuit comprises lithium tantalate ($LiTaO_4$).

18. The flame detector according to claim 1, wherein the photoelectric means of the second circuit comprises a silicon photoelectric cell.

* * * * *